US008667905B2

(12) United States Patent
Anderson et al.

(10) Patent No.: US 8,667,905 B2
(45) Date of Patent: Mar. 11, 2014

(54) PALLET SYSTEM

(75) Inventors: David P. Anderson, Orlando, FL (US); Brandon M. D'Emidio, Atlanta, GA (US); Daniel J. Lantz, Orlando, FL (US); John Thomas Storteboom, Orlando, FL (US)

(73) Assignee: Chep Technology Pty Limited, Sydney NSW (AU)

( * ) Notice: Subject to any disclaimer, the term of this patent is extended or adjusted under 35 U.S.C. 154(b) by 0 days.

(21) Appl. No.: 13/559,575

(22) Filed: Jul. 26, 2012

(65) Prior Publication Data

US 2014/0026790 A1 Jan. 30, 2014

(51) Int. Cl.
*B65D 19/00* (2006.01)

(52) U.S. Cl.
USPC ..... 108/51.11

(58) Field of Classification Search
USPC ..... 108/51.11, 51.3, 56.1, 56.3, 57.1, 108/57.17, 57.18, 57.21, 57.23–57.25
See application file for complete search history.

(56) References Cited

U.S. PATENT DOCUMENTS

| | | | | |
|---|---|---|---|---|
| 2,468,026 | A * | 4/1949 | Boone | 108/57.1 |
| 2,475,370 | A * | 7/1949 | Bitney | 108/57.14 |
| 3,204,583 | A * | 9/1965 | Nicholson | 108/51.11 |
| 3,645,215 | A * | 2/1972 | Kirkpatrick | 108/57.23 |
| 3,855,945 | A * | 12/1974 | Sebilleau et al. | 108/57.1 |
| 6,708,629 | B2 * | 3/2004 | Dumouchel | 108/57.25 |
| 2007/0245932 | A1 * | 10/2007 | Nielsen | 108/51.11 |

* cited by examiner

*Primary Examiner* — Matthew Ing

(74) *Attorney, Agent, or Firm* — Ido Tuchman

(57) ABSTRACT

A method to improve a pallet may include joining into a pallet four C-brackets, a pallet-deck, a first bottom-deck member, and a second bottom-deck member where two of the four C-brackets insides face two of the other four C-brackets' insides. The method may also include sizing a port to receive load-handling equipment tines formed by the four C-brackets, the pallet-deck, the first bottom-deck member, and the second bottom-deck member.

20 Claims, 11 Drawing Sheets

PALLET SYSTEM

BACKGROUND OF THE INVENTION

1. Field of the Invention

The invention relates to the field of pallet systems, and, more particularly, to an improved pallet system.

2. Description of Background

Shippers, manufacturers, wholesalers, retailers, and/or the like move merchandise, materials, and/or the like, e.g. load, to customers, end-users, and/or the like on shipping platforms, e.g. pallet, containers, and/or the like. This technique of bulk shipping may reduce the cost related to moving the load when compared to non-bulk shipping methods. As a result, all parties in the distribution chain may benefit from lower shipping costs due to this bulk shipping technique.

SUMMARY OF THE INVENTION

According to one embodiment of the invention, an improved pallet system may include a pallet-deck that includes a first corner, a second corner, a third corner, and a fourth corner. The system may also include a first bottom-deck member, a first C-bracket fixedly adjoining an end of the first bottom-deck member to the first corner by the first C-bracket's top and bottom, respectively, and a second C-bracket fixedly adjoining another end of the first bottom-deck member to the second corner by the second C-bracket's top and bottom, respectively. The system may further include a second bottom-deck member, a third C-bracket fixedly adjoining an end of the second bottom-deck member to the third corner by the C-bracket's top and bottom, respectively, and a fourth C-bracket fixedly adjoining another end of the second bottom-deck member to the fourth corner by the second C-bracket's top and bottom, respectively. The system may additionally include a port sized to receive load-handling equipment tines formed by the pallet-deck, the first bottom-deck member, the second bottom-deck member, and an inside of each of the first C-bracket, the second C-bracket, the third C-bracket, and the fourth C-bracket.

At least half of the pallet-deck may comprise a load bearing surface. The first C-bracket, the second C-bracket, the third C-bracket, and the fourth C-bracket may each comprise a wide-side at a right angle to the C-shaped profile.

The wide-side has target measurements of the first bottom-deck member and/or the second bottom-deck member dimensions. The first C-bracket, the second C-bracket, the third C-bracket, and the fourth C-bracket each comprises strengthening features that increases the load bearing capacity of each C-bracket.

The port, the pallet-deck, the first C-bracket, the second C-bracket, the third C-bracket, the fourth C-bracket, the first bottom-deck member, and the second bottom-deck member produce a one-way entry quarter-pallet. The one-way entry quarter-pallet's pallet-deck has target measurements of 24 inches by 20 inches, and the port is 19-24 inches across.

The port, the pallet-deck, the first C-bracket, the second C-bracket, the third C-bracket, the fourth C-bracket, the first bottom-deck member, and the second bottom-deck member produce a two-way entry half-pallet. The two-way entry half-pallet's pallet-deck has target measurements of 40 inches by 24 inches, and the port for one of the two-entry ways is 19-24 inches across, and a second port for the other of the two-entry ways is 19-40 inches across.

Another aspect of the invention is a method for improving a pallet system. The method may include joining into a pallet four C-brackets, a pallet-deck, a first bottom-deck member, and a second bottom-deck member where two of the four C-brackets insides face two of the other four C-brackets' insides. The method may also include sizing a port to receive load-handling equipment tines formed by the four C-brackets, the pallet-deck, the first bottom-deck member, and the second bottom-deck member.

The method may further include sizing a wide-side of each one of the four C-brackets to one dimension of at least one of the first bottom-deck member and the second bottom-deck member. The method may additionally include adding strengthening features to each of the four C-brackets to increase the load bearing capacity of each of the four C-brackets.

The method may also include producing a one-way entry quarter-pallet with the port, the pallet-deck, the four C-brackets, the first bottom-deck member, and the second bottom-deck member. The method may further include targeting the one-way entry quarter-pallet's pallet-deck to have measurements of 24 inches by 20 inches, and the port is 20-24 inches across.

The method may additionally include producing a two-way entry half-pallet with the port, the pallet-deck, the four C-brackets, the first bottom-deck member, and the second bottom-deck member. The method may also include targeting the two-way entry half-pallet's pallet-deck to have measurements of 40 inches by 24 inches, and the port for one of the two-entry ways is 20-24 inches across, and a second port for the other of the two-entry ways is 20-40 inches across.

An alternative system to improve a pallet may include a pallet-deck with at least half of the pallet-deck comprising a load bearing surface, and the pallet-deck including a first corner, a second corner, a third corner, and a fourth corner. The system may also include a first bottom-deck member and a first C-bracket fixedly adjoining an end of the first bottom-deck member to the first corner by the first C-bracket's top and bottom, respectively, and the first C-bracket comprises strengthening features to increase its load bearing capacity. The system may further include a second C-bracket fixedly adjoining another end of the first bottom-deck member to the second corner by the second C-bracket's top and bottom, respectively, and the second C-bracket comprises strengthening features to increase its load bearing capacity. The system may additionally include a second bottom-deck member and a third C-bracket fixedly adjoining an end of the second bottom-deck member to the third corner by the C-bracket's top and bottom, respectively, and the third C-bracket comprises strengthening features to increase its load bearing capacity. The system may also include a fourth C-bracket fixedly adjoining another end of the second bottom-deck member to the fourth corner by the fourth C-bracket's top and bottom, respectively, and the fourth C-bracket comprises strengthening features to increase its load bearing capacity. The system may further include a port sized to receive load-handling equipment tines and is formed by the pallet-deck, the first bottom-deck member, the second bottom-deck member, and the inside of the C of each of the first C-bracket, the second C-bracket, the third C-bracket, and the fourth C-bracket.

The first C-bracket, the second C-bracket, the third C-bracket, and the fourth C-bracket may each comprises a wide-side at a right angle to the C-shaped profile. The port, the pallet-deck, the first C-bracket, the second C-bracket, the third C-bracket, the fourth C-bracket, the first bottom-deck member, and the second bottom-deck member may produce a one-way entry quarter-pallet. The port, the pallet-deck, the first C-bracket, the second C-bracket, the third C-bracket, the fourth C-bracket, the first bottom-deck member, and the second bottom-deck member may produce a two-way entry half-pallet.

DETAILED DESCRIPTION OF THE INVENTION

Figure 1:
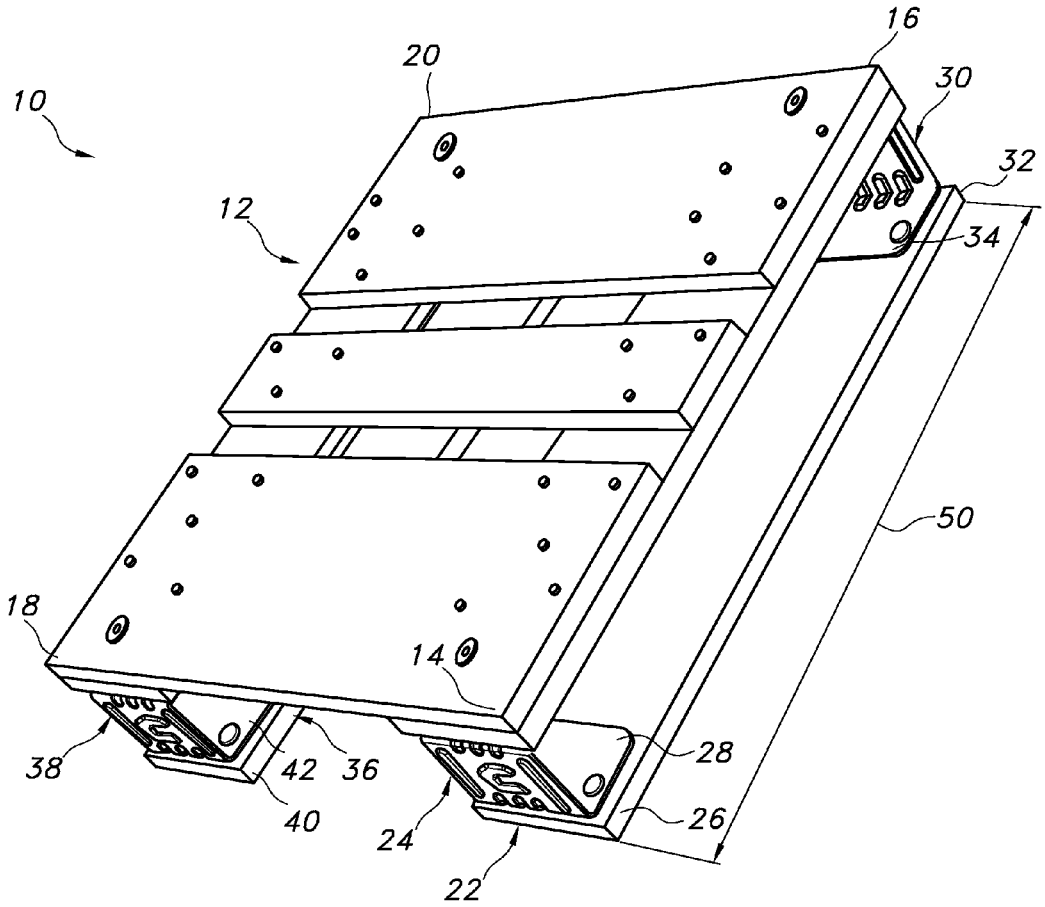
FIG. 1 illustrates an improved pallet system in accordance with the invention.
Figure 2:
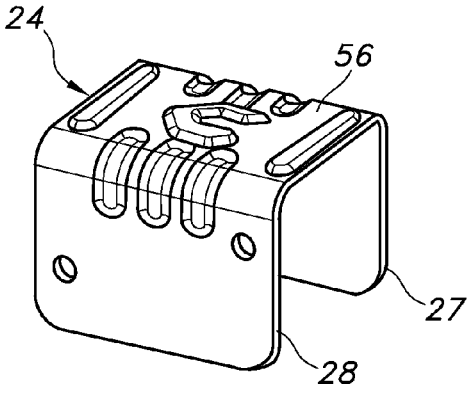
FIG. 2 is an isometric side-bottom view of a C-bracket in accordance with the invention.
Figure 3:
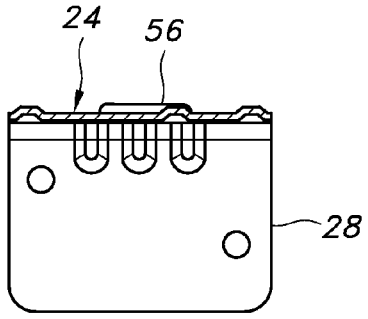
FIG. 3 is a cut-away top view of the C-bracket of FIG. 2 to show the bottom of the C-bracket.
Figure 4:
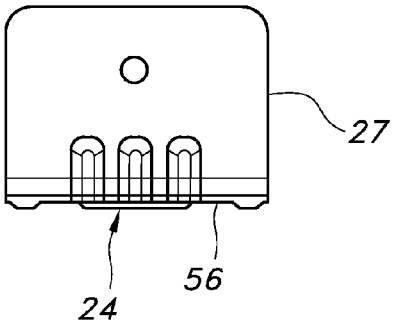
FIG. 4 is a top view of the C-bracket of FIG. 2.
Figure 5:
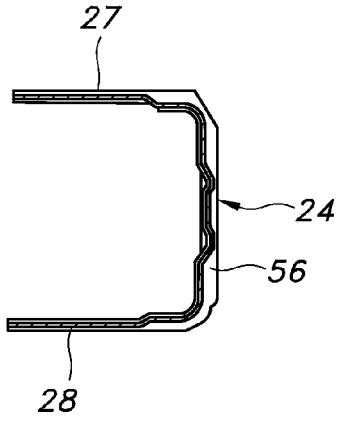
FIG. 5 is a side view of the C-bracket of FIG. 2 to show the C-profile.

The invention will now be described more fully hereinafter with reference to the accompanying drawings, in which preferred embodiments of the invention are shown. Like numbers refer to like elements throughout.

With reference now to FIGS. 1-7, an improved pallet system 10 is initially described. In an embodiment, the system 10 includes a pallet-deck 12 that includes a first corner 14, a second corner 16, a third corner 18, and a fourth corner 20. The pallet-deck 12 comprises wood, metal, plastic, and/or the like to provide a weight bearing surface.

The system 10 also includes a first bottom-deck member 22 that comprises wood, metal, plastic, and/or the like to provide a weight bearing surface. The system 10 also includes a first C-bracket 24 fixedly adjoining an end 26 of the first bottom-deck member 22 to the first corner 14 by the first C-bracket's top and bottom 28, respectively, and a second C-bracket 30 fixedly adjoining another end 32 of the first bottom-deck member 22 to the second corner 16 by the second C-bracket's top and bottom 34, respectively. The first C-bracket 24 and the second C-bracket 30 are similar elements structurally and/or in function.

The system 10 further includes a second bottom-deck member 36, a third C-bracket 38 fixedly adjoining an end 40 of the second bottom-deck member to the third corner 18 by the C-bracket's top and bottom 42, respectively, and a fourth C-bracket (not shown) fixedly adjoining another end of the second bottom-deck member to the fourth corner 20 by the second C-bracket's top and bottom, respectively. The first C-bracket 24, the second C-bracket 30, the third C-bracket 38, and the fourth C-bracket are similar elements structurally and/or in function, and engage the pallet-deck 12 and/or the first bottom-deck member 22 and/or the second bottom-deck member 36 in a similar manner.

The system 10 additionally includes a port 50 sized to receive load-handling equipment tines 52 and/or 54 formed by the pallet-deck 12, the first bottom-deck member 22, the second bottom-deck member 36, and an inside of each of the first C-bracket 24, the second C-bracket 30, the third C-bracket 38, and the fourth C-bracket.

In one embodiment, at least half of the pallet-deck 12 comprises a load bearing surface. For example, the non-load bearing portion will be open space bounded by the first corner 14, the second corner 16, the third corner 18, and the fourth corner 20. In another embodiment, the first C-bracket 24, the second C-bracket 30, the third C-bracket 38, and the fourth C-bracket each comprises a wide-side 56 at a right angle to the C-shaped profile.

Figure 6:
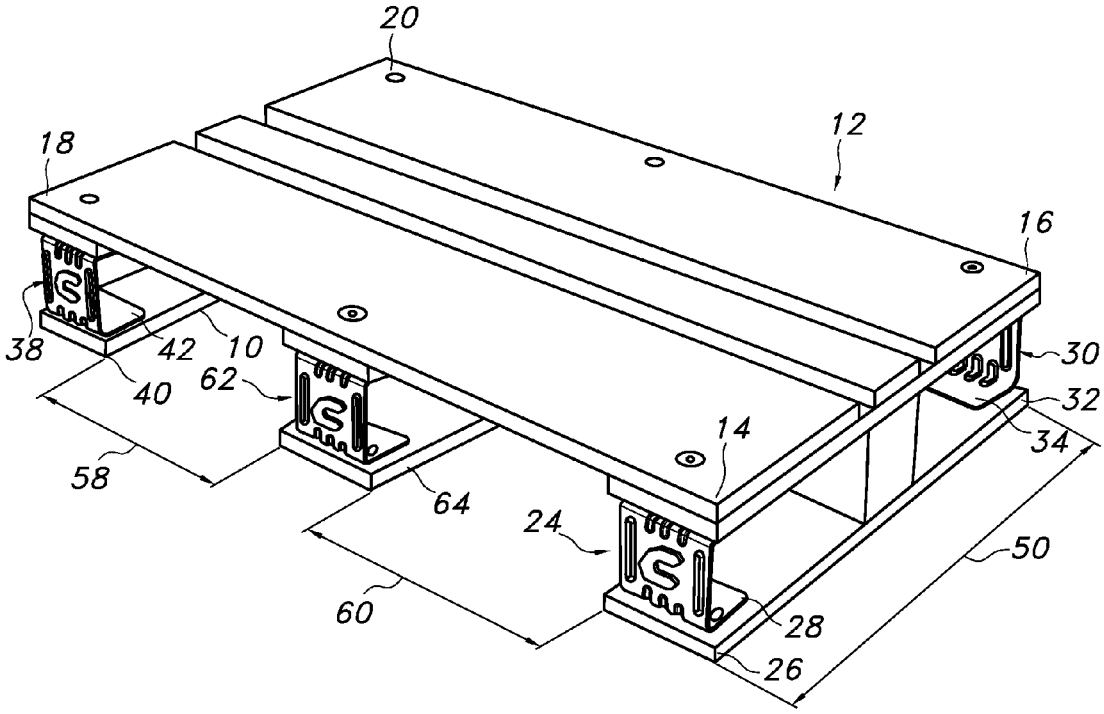
FIG. 6 illustrates a two-way entry half-pallet embodiment of FIG. 1.
Figure 7:
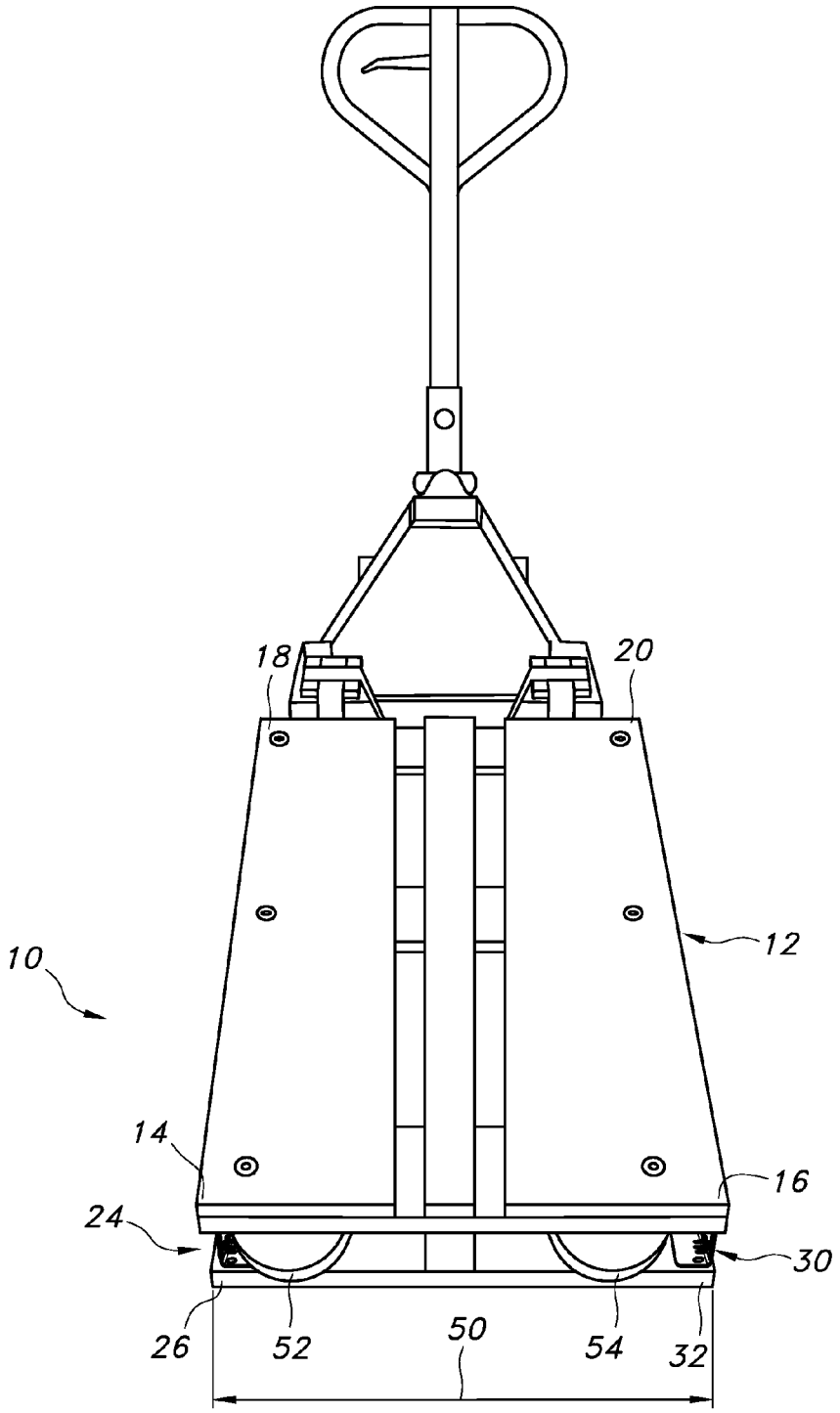
FIG. 7 illustrates the two-way entry half-pallet embodiment of FIG. 6 engaged by a pallet truck.

In one embodiment, the wide-side 56 has target measurements of the first bottom-deck member 22 and/or the second bottom-deck member 36 dimensions. Stated another way, the wide-side 56 dimensions are close to the size of either bottom-deck component as illustrated in FIGS. 1 and 6. In another embodiment, the first C-bracket 24, the second C-bracket 30, the third C-bracket 38, and the fourth C-bracket each comprises strengthening features that increases the load bearing capacity of each C-bracket. For instance, each C-bracket includes stampings, folds, and/or bends on its surface.

In one embodiment, the port 50, the pallet-deck 12, the first C-bracket 24, the second C-bracket 30, the third C-bracket 38, the fourth C-bracket, the first bottom-deck member 22, and the second bottom-deck member 36 produce a one-way entry quarter-pallet. In other words, a pallet jack tines 52 and 54 can enter the port 50 on one side of the system 10 and the overall size of the system bounded by the first corner 14, the second corner 16, the third corner 18, and the fourth corner 20 is approximately 24 inches by 20 inches. In another embodiment, the one-way entry quarter-pallet's pallet-deck 12 has target measurements of 24 inches by 20 inches, and the port is 19-24 inches across.

In one embodiment, the port 50, the pallet-deck 12, the first C-bracket 24, the second C-bracket 30, the third C-bracket 38, the fourth C-bracket, the first bottom-deck member 22, and the second bottom-deck member 36 produce a two-way entry half-pallet. The two-way entry half-pallet's pallet-deck 12 bounded by the first corner 14, the second corner 16, the third corner 18, and the fourth corner 20 has target measurements of 40 inches by 24 inches, and the port 50 for one of the two-entry ways is 19-24 inches across, and a second port 58 and 60 for the other of the two-entry ways is 19-40 inches across.

Figure 8:
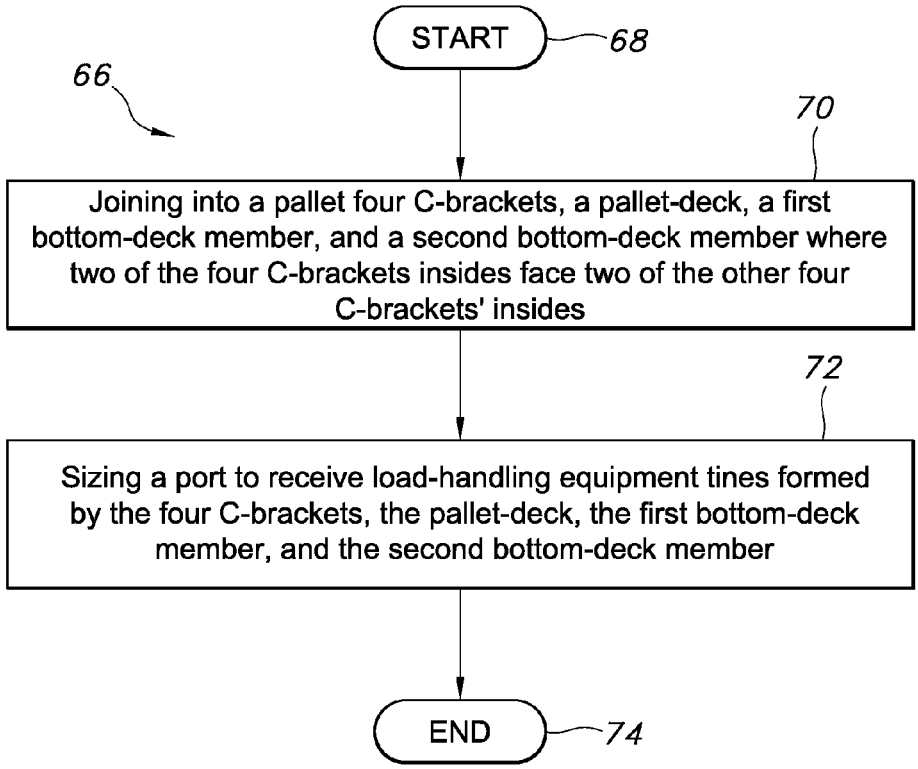
FIG. 8 is a flowchart illustrating method aspects according to the invention.

Another aspect of the invention is a method for improving a pallet system, which is now described with reference to flowchart 66 of FIG. 8. The method begins at Block 68 and may include joining into a pallet four C-brackets, a pallet-deck, a first bottom-deck member, and a second bottom-deck member where two of the four C-brackets insides face two of the other four C-brackets' insides at Block 70. The method may also include sizing a port to receive load-handling equipment tines formed by the four C-brackets, the pallet-deck, the first bottom-deck member, and the second bottom-deck member at Block 72. The method ends at Block 74.

Figure 9:
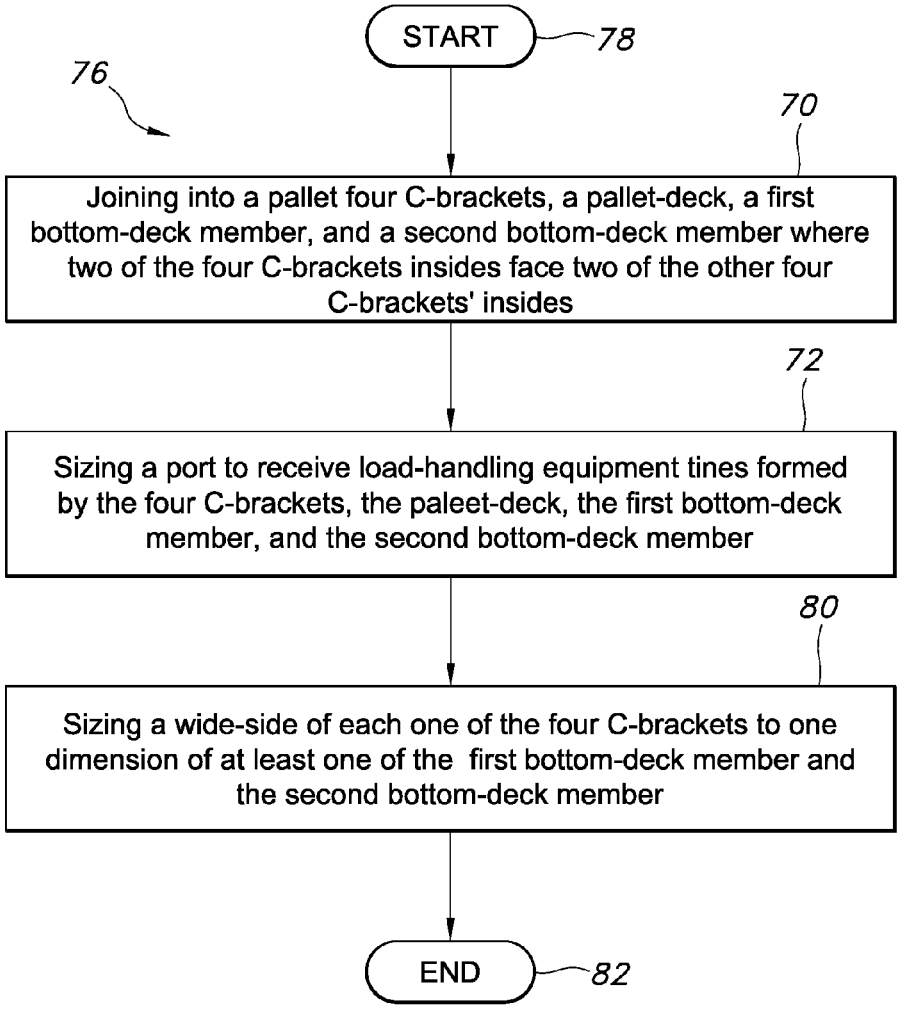
FIG. 9 is a flowchart illustrating method aspects according to the method of FIG. 8.

In another method embodiment, which is now described with reference to flowchart 76 of FIG. 9, the method begins at Block 78. The method may include the steps of FIG. 8 at Blocks 70 and 72. The method may additionally include sizing a wide-side of each one of the four C-brackets to one dimension of at least one of the first bottom-deck member and the second bottom-deck member at Block 80. The method ends at Block 82.

Figure 10:
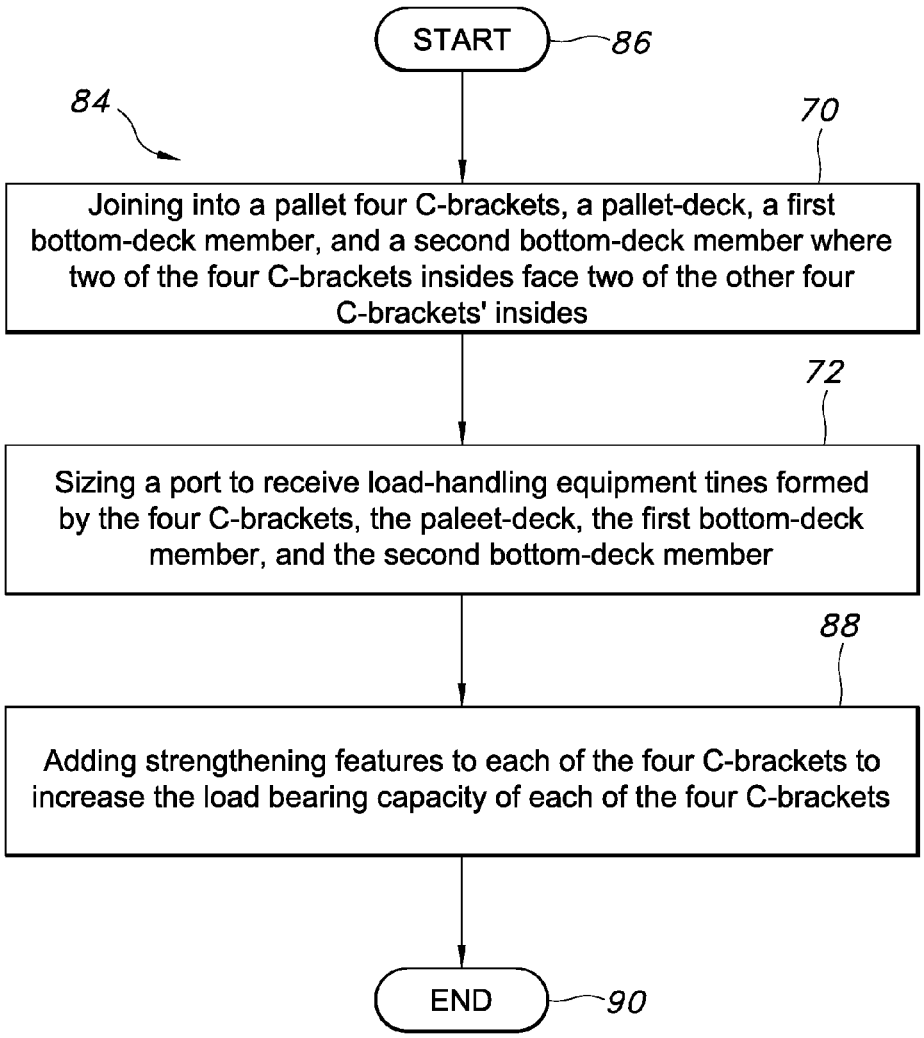
FIG. 10 is a flowchart illustrating method aspects according to the method of FIG. 8.

In another method embodiment, which is now described with reference to flowchart 84 of FIG. 10, the method begins at Block 86. The method may include the steps of FIG. 8 at Blocks 70 and 72. The method may additionally include adding strengthening features to each of the four C-brackets to increase the load bearing capacity of each of the four C-brackets at Block 88. The method ends at Block 90.

Figure 11:
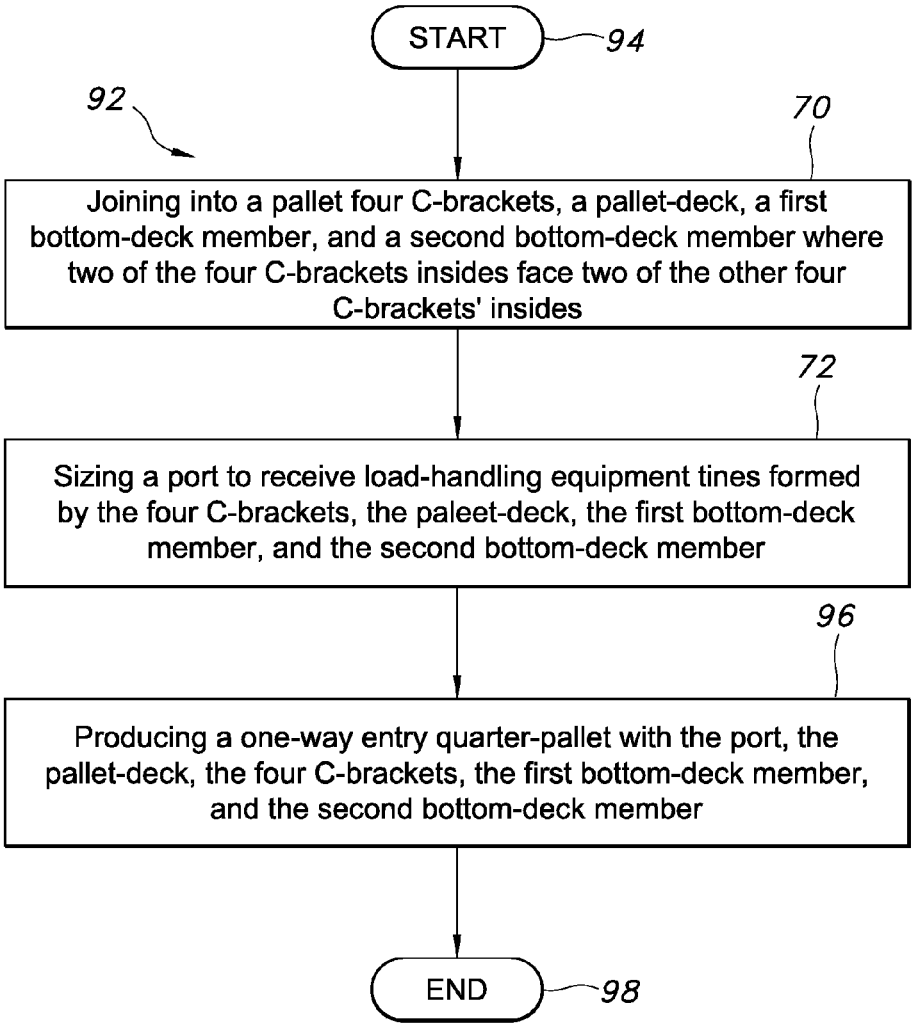
FIG. 11 is a flowchart illustrating method aspects according to the method of FIG. 8.

In another method embodiment, which is now described with reference to flowchart 92 of FIG. 11, the method begins at Block 94. The method may include the steps of FIG. 8 at Blocks 70 and 72. The method may also include producing a one-way entry quarter-pallet with the port, the pallet-deck, the four C-brackets, the first bottom-deck member, and the second bottom-deck member at Block 96. The method ends at Block 98.

Figure 12:
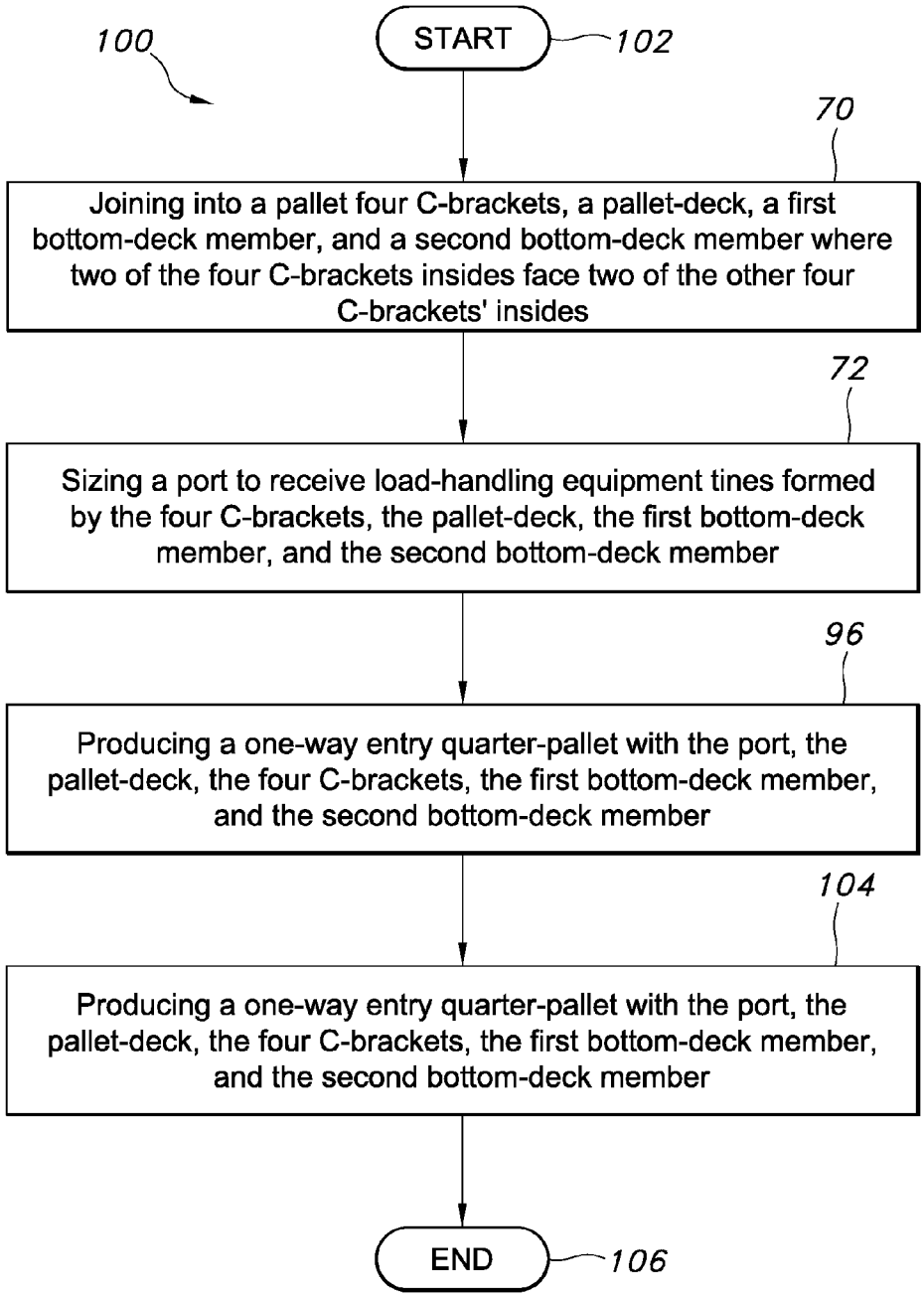
FIG. 12 is a flowchart illustrating method aspects according to the method of FIG. 11.

In another method embodiment, which is now described with reference to flowchart 100 of FIG. 12, the method begins at Block 102. The method may include the steps of FIG. 11 at Blocks 70, 72, and 96. The method may further include targeting the one-way entry quarter-pallet's pallet-deck to have measurements of 24 inches by 20 inches, and the port is 20-24 inches across at Block 104. The method ends at Block 106.

Figure 13:
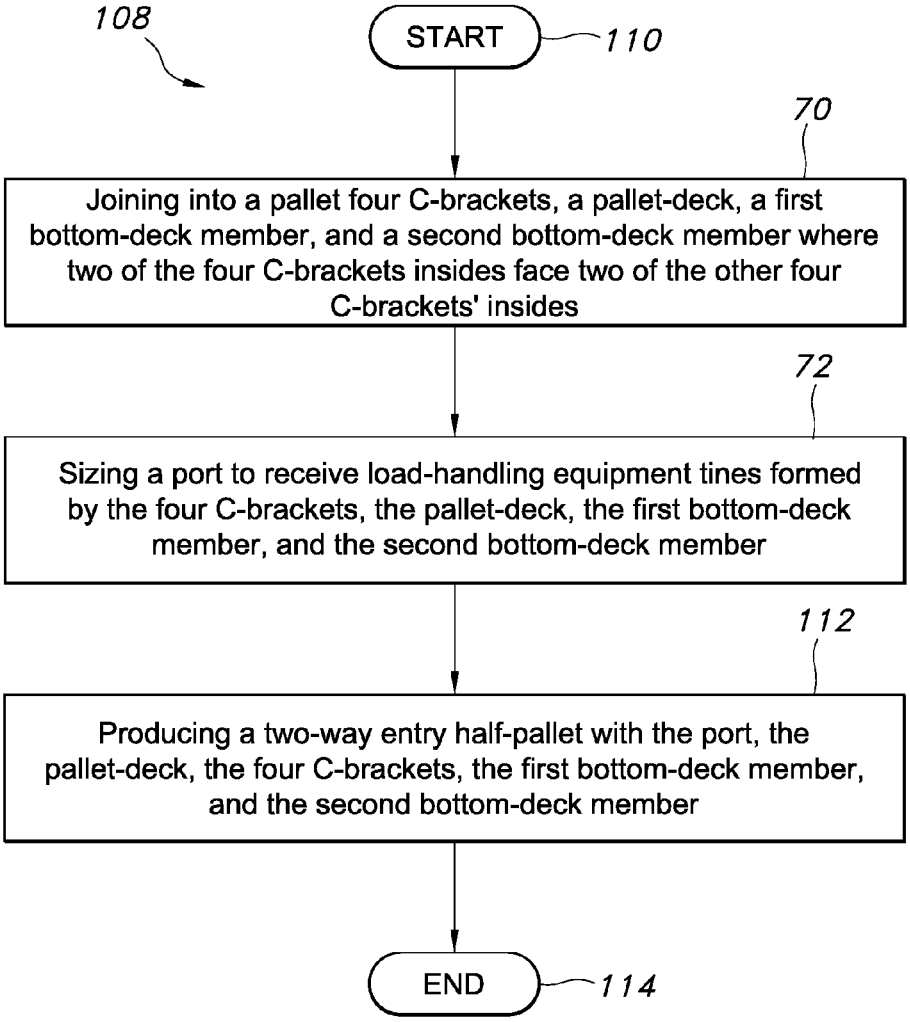
FIG. 13 is a flowchart illustrating method aspects according to the method of FIG. 8.

In another method embodiment, which is now described with reference to flowchart 108 of FIG. 13, the method begins at Block 110. The method may include the steps of FIG. 8 at Blocks 70 and 72. The method may additionally include producing a two-way entry half-pallet with the port, the pallet-deck, the four C-brackets, the first bottom-deck member, and the second bottom-deck member at Block 112. The method ends at Block 114.

Figure 14:
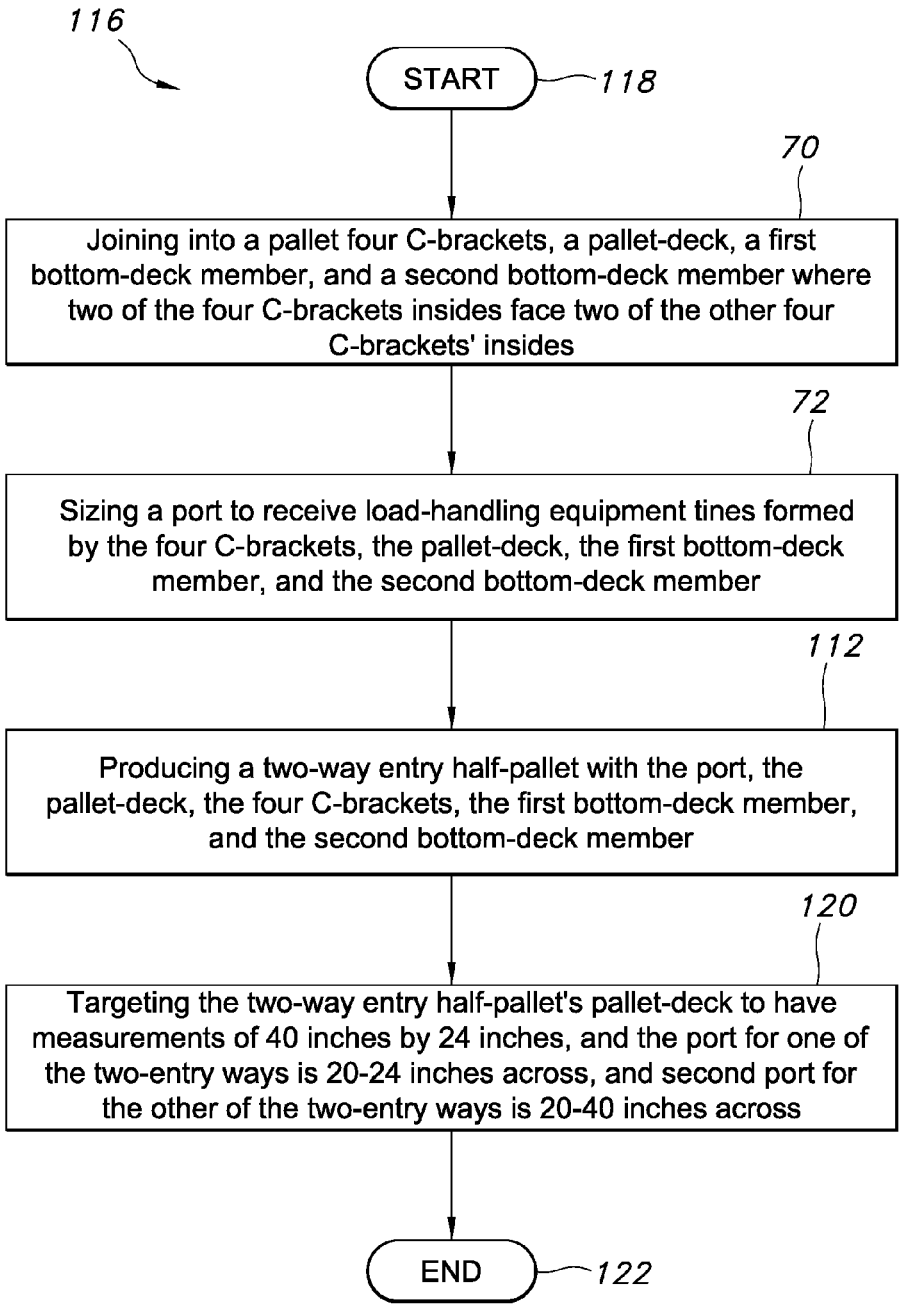
FIG. 14 is a flowchart illustrating method aspects according to the method of FIG. 13.

In another method embodiment, which is now described with reference to flowchart 116 of FIG. 14, the method begins at Block 118. The method may include the steps of FIG. 13 at Blocks 70, 72, and 112. The method may also include targeting the two-way entry half-pallet's pallet-deck to have measurements of 40 inches by 24 inches, and the port for one of the two-entry ways is 20-24 inches across, and a second port for the other of the two-entry ways is 20-40 inches across at Block 120. The method ends at Block 122.

An alternative system 10 to improve a pallet includes a pallet-deck 12 with at least half of the pallet-deck comprising a load bearing surface, and the pallet-deck including a first corner 14, a second corner 16, a third corner 18, and a fourth corner 20. The system may also include a first bottom-deck member 22 and a first C-bracket 24 fixedly adjoining an end 26 of the first bottom-deck member to the first corner 14 by the first C-bracket's top and bottom 28, respectively, and the first C-bracket comprises strengthening features to increase its load bearing capacity. The system 10 further includes a second C-bracket 30 fixedly adjoining another end 32 of the first bottom-deck member 22 to the second corner 16 by the second C-bracket's top and bottom 34, respectively, and the second C-bracket comprises strengthening features to increase its load bearing capacity. The system 10 additionally includes a second bottom-deck member 36 and a third C-bracket 38 fixedly adjoining an end 40 of the second bottom-deck member to the third corner 18 by the C-bracket's top and bottom 42, respectively, and the third C-bracket comprises strengthening features to increase its load bearing capacity. The system 10 also includes a fourth C-bracket fixedly adjoining another end of the second bottom-deck member 36 to the fourth corner 20 by the fourth C-bracket's top and bottom, respectively, and the fourth C-bracket comprises strengthening features to increase its load bearing capacity. The system 10 further includes a port 50 sized to receive load-handling equipment tines 52 and 54 and is formed by the pallet-deck 12, the first bottom-deck member 22, the second bottom-deck member 36, and the inside of the C of each of the first C-bracket 24, the second C-bracket 30, the third C-bracket 38, and the fourth C-bracket.

In one embodiment, the first C-bracket 24, the second C-bracket 30, the third C-bracket 38, and the fourth C-bracket each comprises a wide-side 56 at a right angle to the C-shaped profile. In another embodiment, the port 50, the pallet-deck 12, the first C-bracket 24, the second C-bracket 30, the third C-bracket 38, the fourth C-bracket, the first bottom-deck member 22, and the second bottom-deck member 36 produce a one-way entry quarter-pallet.

In another embodiment, the port 50, the pallet-deck 12, the first C-bracket 24, the second C-bracket 30, the third C-bracket 38, the fourth C-bracket, the first bottom-deck member 22, and the second bottom-deck member 36 produce a two-way entry half-pallet. In view of the foregoing, the system 10 provides an improved pallet system.

It should be noted that in some alternative implementations, the functions noted in a flowchart block may occur out of the order noted in the figures. For instance, two blocks shown in succession may, in fact, be executed substantially concurrently, or the blocks may sometimes be executed in the reverse order, depending upon the functionality involved because the flow diagrams depicted herein are just examples. There may be many variations to these diagrams or the steps (or operations) described therein without departing from the spirit of the invention. For example, the steps may be performed concurrently and/or in a different order, or steps may be added, deleted, and/or modified. All of these variations are considered a part of the claimed invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A shipping pallet comprising:

a pallet-deck that includes a first corner, a second corner, a third corner, and a fourth corner;

a first bottom-deck member;

a first C-bracket fixedly adjoining an end of the first bottom-deck member to the first corner by the first C-bracket's top and bottom, respectively;

a second C-bracket fixedly adjoining another end of the first bottom-deck member to the second corner by the second C-bracket's top and bottom, respectively;

a second bottom-deck member;

a third C-bracket fixedly adjoining an end of the second bottom-deck member to the third corner by the C-bracket's top and bottom, respectively;

a fourth C-bracket fixedly adjoining another end of the second bottom-deck member to the fourth corner by the second C-bracket's top and bottom, respectively;

a first port sized to receive load-handling equipment tines, the first port formed by the pallet-deck, the first bottom-deck member, and an inside of each of the first C-bracket and the third C-bracket, the first port being unobstructed between the inside of each of the first C-bracket and the third C-bracket; and a second port sized to receive the load-handling equipment tines, the second port formed by the pallet-deck, the second bottom-deck member, an inside of each of the second C-bracket and the fourth C-bracket, the second port being unobstructed between the inside of each of second C-bracket and the fourth C-bracket; and wherein the first C-bracket, the second C-bracket, the third C-bracket and the fourth C-bracket are separate from each other.

2. The shipping pallet of claim 1 wherein at least half of the pallet-deck comprises a load bearing surface.

3. The shipping pallet of claim 1 wherein the first C-bracket, the second C-bracket, the third C-bracket, and the fourth C-bracket each comprises a wide-side at a right angle to the C-shaped profile.

4. The shipping pallet of claim 3 wherein the wide-side has target measurements of at least one of the first bottom-deck member and the second bottom-deck member dimensions.

5. The shipping pallet of claim 1 wherein the first C-bracket, the second C-bracket, the third C-bracket, and the fourth C-bracket each comprises strengthening features that increases the load bearing capacity of each C-bracket.

6. The shipping pallet of claim 1 wherein the port, the pallet-deck, the first C-bracket, the second C-bracket, the third C-bracket, the fourth C-bracket, the first bottom-deck member, and the second bottom-deck member produce a one-way entry quarter-pallet.

7. The shipping pallet of claim 6 wherein the one-way entry quarter-pallet's pallet-deck has target measurements of 24 inches by 20 inches, and the port is 19-24 inches across.

8. The shipping pallet of claim 1 wherein the port, the pallet-deck, the first C-bracket, the second C-bracket, the third C-bracket, the fourth C-bracket, the first bottom-deck member, and the second bottom-deck member produce a two-way entry half-pallet.

9. The shipping pallet of claim 8 wherein the two-way entry half-pallet's pallet-deck has target measurements of 40 inches by 24 inches, and the port for one of the two-entry ways is 19-24 inches across, and a second port for the other of the two-entry ways is 19-40 inches across.

10. A method for constructing a shipping pallet, the method comprising:

joining into a pallet four C-brackets, a pallet-deck, a first bottom-deck member, and a second bottom-deck member where two of the four C-brackets insides face two of the other four C-brackets' insides, the four C-brackets being separate from each other and are not directly joined to each other; and sizing a first port to receive load-handling equipment tines, the first port formed by an inside of a first two C-brackets of the four C-brackets, the pallet-deck, and the first bottom-deck member, the first port being unobstructed between the inside of the first two C-brackets; and sizing a second port to receive load-handling equipment tines, the second port formed by an inside of a second two C-brackets of the four C-brackets, the pallet-deck, and the second bottom-deck member, the second port being unobstructed between the inside of the second two C-brackets.

11. The method of claim 10 further comprising sizing a wide-side of each one of the four C-brackets to one dimension of at least one of the first bottom-deck member and the second bottom-deck member.

12. The method of claim 10 further comprising adding strengthening features to each of the four C-brackets to increase the load bearing capacity of each of the four C-brackets.

13. The method of claim 10 further comprising producing a one-way entry quarter-pallet with the port, the pallet-deck, the four C-brackets, the first bottom-deck member, and the second bottom-deck member.

14. The method of claim 13 further comprising targeting the one-way entry quarter-pallet's pallet-deck to have measurements of 24 inches by 20 inches, and the port is 19-24 inches across.

15. The method of claim 10 further comprising producing a two-way entry half-pallet with the port, the pallet-deck, the four C-brackets, the first bottom-deck member, and the second bottom-deck member.

16. The method of claim 15 further comprising targeting the two-way entry half-pallet's pallet-deck to have measurements of 40 inches by 24 inches, and the port for one of the two-entry ways is 19-24 inches across, and a second port for the other of the two-entry ways is 19-40 inches across.

17. A shipping pallet comprising:

a pallet-deck with at least half of the pallet-deck comprising a load bearing surface, and the pallet-deck includes a first corner, a second corner, a third corner, and a fourth corner;

a first bottom-deck member;

a first C-bracket fixedly adjoining an end of the first bottom-deck member to the first corner by the first C-bracket's top and bottom, respectively, and the first C-bracket comprises strengthening features to increase its load bearing capacity;

a second C-bracket fixedly adjoining another end of the first bottom-deck member to the second corner by the second C-bracket's top and bottom, respectively, and the second C-bracket comprises strengthening features to increase its load bearing capacity;

a second bottom-deck member;

a third C-bracket fixedly adjoining an end of the second bottom-deck member to the third corner by the C-bracket's top and bottom, respectively, and the third C-bracket comprises strengthening features to increase its load bearing capacity;

a fourth C-bracket fixedly adjoining another end of the second bottom-deck member to the fourth corner by the fourth C-bracket's top and bottom, respectively, and the fourth C-bracket comprises strengthening features to increase its load bearing capacity; and a first port sized to receive load-handling equipment tines, the first port formed by the pallet-deck, the first bottom-deck member, and an inside of each of the first C-bracket and the third C-bracket, the first port being unobstructed between the inside of each of the first C-bracket and the third C-bracket; and a second port sized to receive the load-handling equipment tines, the second port formed by the pallet-deck, the second bottom-deck member, an inside of each of the second C-bracket and the fourth C-bracket, the second port being unobstructed between the inside of each of second C-bracket and the fourth C-bracket; and wherein the first C-bracket, the second C-bracket, the third C-bracket and the fourth C-bracket are separate from each other.

18. The shipping pallet of claim 17 wherein the first C-bracket, the second C-bracket, the third C-bracket, and the fourth C-bracket each comprises a wide-side at a right angle to the C-shaped profile.

19. The shipping pallet of claim 17 wherein the port, the pallet-deck, the first C-bracket, the second C-bracket, the third C-bracket, the fourth C-bracket, the first bottom-deck member, and the second bottom-deck member produce a one-way entry quarter-pallet.

20. The shipping pallet of claim 17 wherein the port, the pallet-deck, the first C-bracket, the second C-bracket, the third C-bracket, the fourth C-bracket, the first bottom-deck member, and the second bottom-deck member produce a two-way entry half-pallet.

* * * * *